US005462237A

United States Patent [19]

Wellmann

[11] Patent Number: 5,462,237

[45] Date of Patent: Oct. 31, 1995

[54] CRUSHING UNIT IN A CLINKER COOLER

[75] Inventor: Hans-Peter Wellmann, Buxtehude, Germany

[73] Assignee: Claudius Peters Aktiengesellschaft, Buxtehude, Germany

[21] Appl. No.: 157,084

[22] PCT Filed: Jun. 5, 1992

[86] PCT No.: PCT/EP92/01265

§ 371 Date: Dec. 3, 1993

§ 102(e) Date: Dec. 3, 1993

[87] PCT Pub. No.: WO92/21441

PCT Pub. Date: Dec. 10, 1992

[30] Foreign Application Priority Data

Jun. 5, 1991 [DE] Germany ..... 41 18 465.3

[51] Int. Cl.[6] ..... F23G 5/033; B02C 1/10; B02C 23/24

[52] U.S. Cl. ..... 241/57; 110/219; 241/65; 241/67; 241/264

[58] Field of Search ..... 241/57, 65, 66, 241/67, 164, 264, 265, 267, 268, 269, 285.1, 300; 110/106, 219

[56] References Cited

U.S. PATENT DOCUMENTS

| | | | |
|---|---|---|---|
| 983,055 | 1/1911 | Hosmann | 241/67 X |
| 1,024,664 | 4/1912 | Baltz | 241/265 X |
| 1,220,257 | 3/1917 | Molander | 241/67 |
| 2,002,224 | 5/1935 | Eastwood | 241/164 X |
| 2,554,697 | 5/1951 | Conway | 241/268 X |

FOREIGN PATENT DOCUMENTS

| | | | |
|---|---|---|---|
| 0148780 | 7/1985 | European Pat. Off. . | |
| 1594155 | 7/1970 | France . | |
| 2194133 | 2/1974 | France . | |
| 266524 | 10/1912 | Germany . | |
| 2925665 | 4/1980 | Germany . | |
| 3238872 | 4/1984 | Germany . | |
| 1032197 | 7/1983 | U.S.S.R. | 241/264 |
| 1240447 | 6/1986 | U.S.S.R. | 241/264 |
| 1278024 | 12/1986 | U.S.S.R. | 241/264 |
| WO85/03887 | 2/1985 | WIPO . | |

OTHER PUBLICATIONS

Soviet Inventions Illustrated, Section P, Week D34, 30 Sep. 1981 Derwent Publications Ltd., London, GB.

*Primary Examiner*—Timothy V. Eley
*Attorney, Agent, or Firm*—Chilton, Alix & Van Kirk

[57] ABSTRACT

A jaw crusher is positioned within a duct connecting a high temperature furnace outlet and a cooler for crushing high temperature cement clinker material discharged by the furnace. The jaws are provided with cooling air-swept ducts that extend through the jaws and into the crushing chamber. The working surfaces of the jaws are provided with imbricated protective elements. A stationary jaw member within the duct provides a partition forming an air flow duct portion and a movable jaw member cooperates with the stationary jaw member to delineate a discharge crushing chamber separated from the air flow duct portion. The movable jaw is positioned at the wall of the duct for easy access while the drive mechanism for the movable jaw is located outside the duct.

11 Claims, 3 Drawing Sheets

CRUSHING UNIT IN A CLINKER COOLER

This application is a continuation of PCT/EP92/012654.

The invention relates to a crushing unit for crushing high-temperature baked material, in particular cement clinker, between a furnace and a cooler.

BACKGROUND AND SUMMARY OF THE INVENTION

The smaller and more even the particle size of the baked material, the more quickly and uniformly it can be cooled. This has a favourable effect on the size of the cooler and the quality of the product. The connection of a crusher for crushing the baked material upstream of the cooler and directly following the furnace has therefore already been considered (DE-A 29 25 665). The service life of the crusher is primarily dependent on its effective temperature load. The latter is determined on the one hand by the intensity of the transfer of heat from the material to components of the crusher which are subject to wear, and on the other hand by the cooling of those components. This load is the lower, the shorter the time of contact between the crusher components and the hot material and the more freely cooling air can be passed through the crusher. From these points of view consideration has been given to percussion impact crushers (FRA-2 194 133, DE-C 33 23 565, DE-A 29 25 665), an autogenous mill (DE-A 29 25 665), air-swept mills DE-B 23 61 060), drop impact crushers (DE-A 35 26 345) and roll crushers (DE-B 27 47 732). When these crushers have active crushing elements, the latter are distinguished in that they rotate and that they are in contact with the baked material only during a small part of their revolution and can be intensively swept over by cooling air during the remainder of their revolution.

Jaw crushers, which are known per se (EP-A-0 148 780, WO-A-85 03 887, SU-782 860, DE-C 266 524), have not hitherto been used for hot material because they do not provide these favourable preconditions for hot operation. On the contrary, the surfaces of the crushing elements are continuously in contact with the hot baked material even when no impulse exchange takes place. As the crushing chamber is filled with material to be crushed, said surfaces are scarcely accessible to a flow of cooling air.

It is thus contrary to previous views that for the purpose of reducing manufacturing and operating costs of the crusher working under hot conditions that the invention proposes a jaw crusher.

The invention has however realized that a jaw crusher arranged in the manner indicated can have advantages over other types of crushers for the following reasons: whereas at temperatures of 1000° to 1500° C. in the latter the crushing elements are subjected to a combination of thermal stress, particularly also temperature change stress, and high specific impact stress while undergoing a rubbing relative movement, in the case of the jaw crusher practically no temperature change stress occurs because both the heat transfer from the material and the cooling action are practically invariable over a period of time, so that protective elements of heat-resistant metal alloys or ceramic materials can be used for the crusher jaw surfaces subjected to stress. Whereas the crushing tools of rotary crushers are practically inaccessible to cooling from the side remote from the material to be crushed, jaw crushers can be more effectively cooled because their entire rear surface, that is to say a surface which is exactly as large as the surface participating in the crushing operation, is available for the introduction of cooling power. The increased thermal stressing of the crushing jaw surfaces through intensive contact with the material to be crushed can thus be effectively countered by the installation of cooling devices in the crushing jaws. The specific impact stress, which in the case of types of crushers rotating at high speed is determined by the relative speed of the crushing elements and the mass of the pieces of material to be crushed, is low in the given case of use for jaw crushers because at the high temperature the material has no substantial hardness.

It has in addition been realized that a jaw crusher is insensitive to the ejection of material from a rotary tubular furnace in an irregular manner over a period of time. Its crushing chamber, which widens in funnel fashion in the upward direction, can easily be made so large, in respect of crushing chamber size and geometry of the crushing mouth, that it can also deal with the greatest fluctuations of the stream of particles and ejection rate to be expected in normal furnace operation, without requiring an intermediate storage space (for example a feed hopper), which under the difficult conditions would have a tendency towards bridge building and caking. The crushed bulk material is discharged through the outlet gap which is situated in the bottom part of the crushing chamber and the width of which is adjustable to a predetermined final particle size of the bulk material.

The fraction of the product particle range entering the crusher with a particle diameter smaller than the width of the outlet gap flows through the crushing chamber without being included in the crushing process, so that no additional superfine particles are produced. By means of a preferably profiled configuration of the stressing surfaces of the crushing jaws and because of the short residence time of the coarse material in the crushing chamber during the crushing operation, the particle range of the material is evenly distributed over the outlet cross-section.

It is thus found that jaw crushers provide a number of unexpectedly good properties for this application, which justify the inventive merit of this selection. However, as a rule the crushing jaws are provided with cooling devices. These may be cooling air-swept ducts which extend through the crushing jaws and lead into the crushing chamber in order to cool not only the crushing jaws but also in particular the material to be crushed. This is expedient when the crushed material tends to sinter together or cake. To ensure that the mouths of the cooling ducts are not clogged by the material to be crushed, they expediently extend downwards under imbricated protective elements, their mouths being protected against the material pressure directed essentially at right angles to the crushing jaw by their arrangement under or behind the downwardly pointing end face of the respective protective element. If it is not necessary for the material which is to be crushed to be itself cooled, internal cooling of the crushing jaws is sufficient, for example by means of coolant ducts. extending parallel to the stressing surface in the crushing jaws.

By means of adjusting devices installed in the cooling air supply and/or distribution ducts, the local intensity of the cooling of the crushing jaws and of the blast of air into the crushing chamber can be adjusted.

The crusher is generally installed in the duct which is disposed between the furnace and the cooler and which conducts the material downwards and the hot air preheated by cooling upwards to the furnace as secondary air. Because of this dual function, the crusher must not fill the entire cross-section of the duct. It is expediently arranged such that its movable crushing jaw is disposed on an outer side of the duct, while the stationary crushing jaw is facing that cross-section of the duct which guides the hot air. This has the advantage that the drive elements for the movable crushing jaw can be situated outside the hot region and be accessible for maintenance. The devices for adjusting the outlet gap are usually provided on the crushing jaw which is stationary during operation. According to the invention, however, provision may be made for said devices also to be associated with the movable crushing jaw, in order to be able to make use of the advantage of arrangement in a cooler region for the adjusting devices also.

To ensure that the operation of the furnace and cooler is not endangered in the case of crusher breakdown and that the crusher does not have to be operated in certain operating situations (for example during no-load operation of the furnace in the cold state), the crusher gap should be adjustable to a size such that it permits the passage of the uncrushed material. In addition, provision can be made for at least the movable jaw of the crusher, but preferably the entire crusher, to be removable from the clinker discharge duct in order to be able to open the duct cross-section or to carry out maintenance work on the crusher.

Finally, provision can be made for a shear strip to be disposed at the bottom end of one crushing jaw, under the crusher outlet gap, in order to cover the outlet gap, at a predetermined distance therefrom, during the working stroke.

The crusher to be used in the context of the arrangement according to the invention may have a different configuration from the conventional crushing jaw shapes, even if its function is one typical of the latter. For example, the movable jaw may be formed by a rotatably mounted roll.

BRIEF DESCRIPTION OF THE DRAWINGS

The invention is explained more fully below with reference to the schematic drawings, in which.

DESCRIPTION OF A PREFERRED EMBODIMENT

Figure 1:
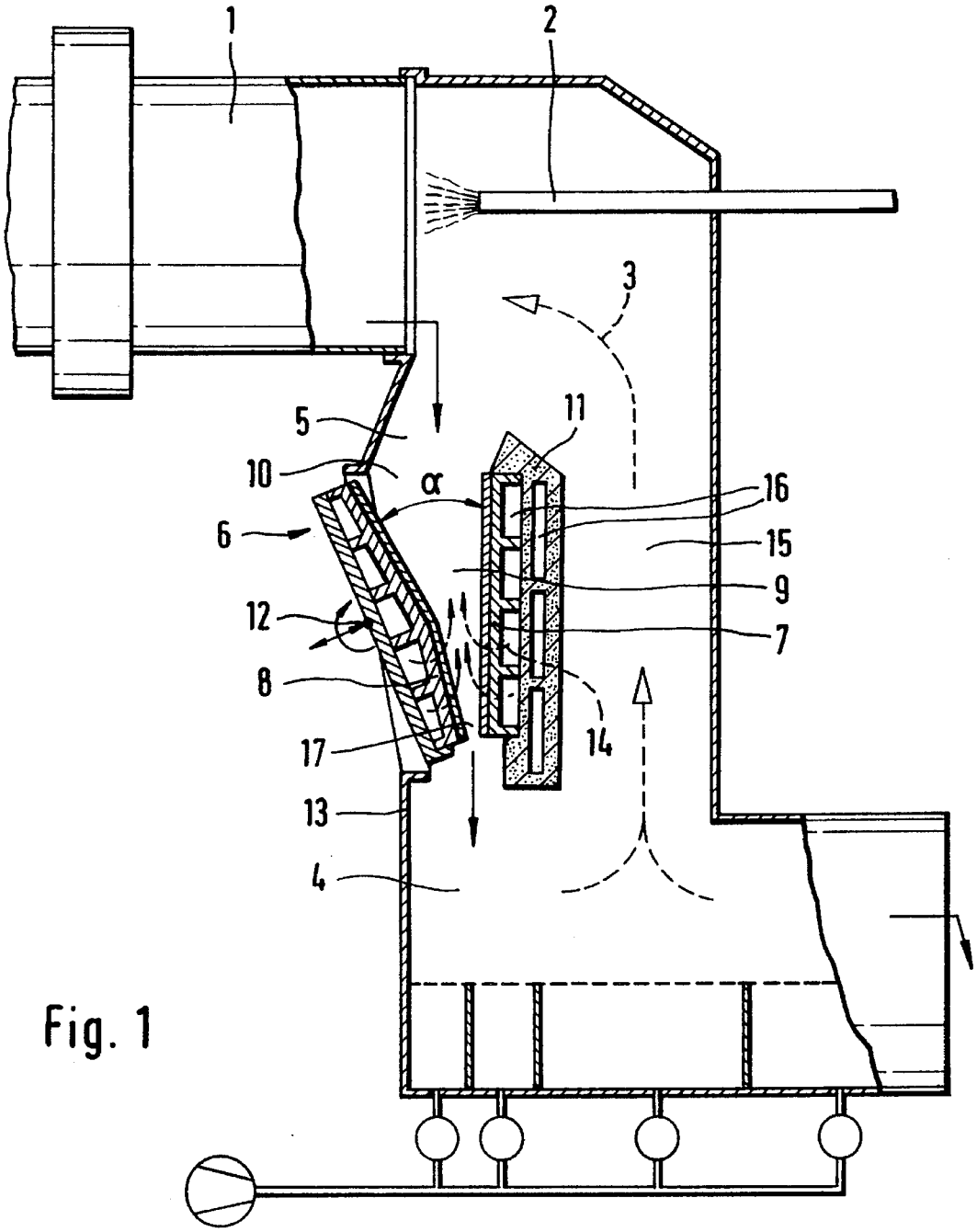
FIG. 1 is a longitudinal section through the unit.

The drawings show the ejection end of a rotary tubular furnace 1, which for example serves to bake cement clinker and is operated with a burner 2 to which the secondary air is fed (arrow 3) from a cooler 4, which may be of conventional type, for example in the form of a fluidized bed cooler for baked products of limited particle size or of a grid cooler having non-fall through plates. It is preferably designed for a high cooling power and a high cooling speed.

The ejection end of the rotary tubular furnace 1 and the inlet of the cooler 4 are disposed one above the other and are connected to one another by a duct divided by a partition 11 into, on the one hand, the clinker discharge duct 5 through which the clinker falls from the furnace to the cooler, and on the other hand a separate hot air duct 15 through which the cooling air heated in the cooler by recuperation of the heat of the clinker passes as secondary air (arrow 3) upwards to the furnace.

Directly beneath the ejection end of the rotary tubular furnace 1 is disposed, inside the clinker discharge duct 5, the crusher which is given the general reference 6 and which is a jaw crusher having a stationary crushing jaw 7, a movable crushing jaw 8 and an adjustable outlet gap 17. Two walls delimit the crushing chamber 9 at the sides. The crushing chamber angle $\alpha$ between the crushing Jaws widens sharply in the top region 10, the crushing mouth, to receive even large pieces of bulk material and a high output of material. Because of the specific properties of the hot material to be crushed, the crushing chamber angle $\alpha$ in the inlet region may amount to $\geqq 30°$, in contrast to the usual configuration. In the bottom region of the crushing chamber, which is provided with the adjustable outlet gap 17, the crushing chamber angle is reduced to a usual size of the order of about 15°. The crushing jaws may also have an arched configuration.

The crusher drive expediently combines, as is known, relative movements of the crushing jaws transversely to the direction of the crushing chamber and parallel thereto, so as to be able to exert both a compressive and a shearing action on the material to be crushed.

The stationary crushing jaw 7 is supported in the partition 11, or a part of the partition may also be constructed as a stationary crushing jaw. The movable crushing jaw 8 is movably suspended on mountings shown schematically at 12 and connected to or containing driving and adjusting devices. At least the movable crushing jaw 8, together with the appertaining parts, but preferably also the stationary crushing jaw 7 can be taken out through an opening provided in the wall 13 of the clinker discharge duct 5 for the purpose of clearing the clinker discharge duct cross-section or for maintenance and replacement purposes.

The two crushing jaws and in particular also the partition 11 contain through ducts 16 to guide cooling air, which after cooling the crushing jaws and the partition is taken out via outlet ducts 21 into the crushing chamber 9 (arrows 14), in order there to cool the material to be crushed and to prevent it from sintering together and caking. Additional fresh air can be mixed with the cooling air, which is fed evenly or pulsatingly, before it enters the crushing chamber. The local intensity of the cooling of the crushing jaws and of the injection of air into the crushing chamber is adjusted by means of adjusting devices installed in the cooling air supply and/or distribution ducts.

Figure 2:
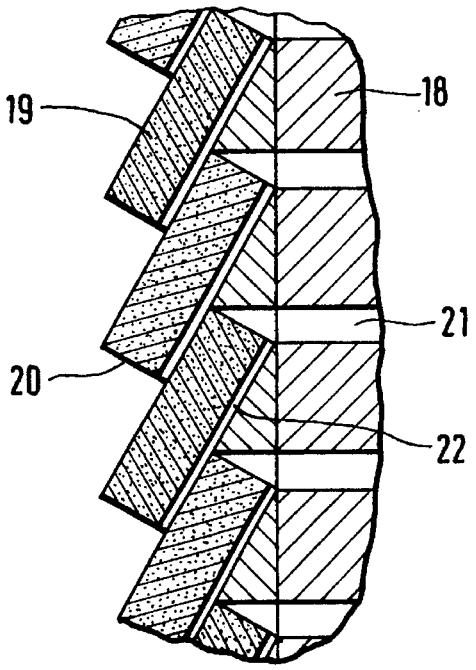
FIGS. 2 to 5 are partial sections through a crushing jaw.
Figure 4:
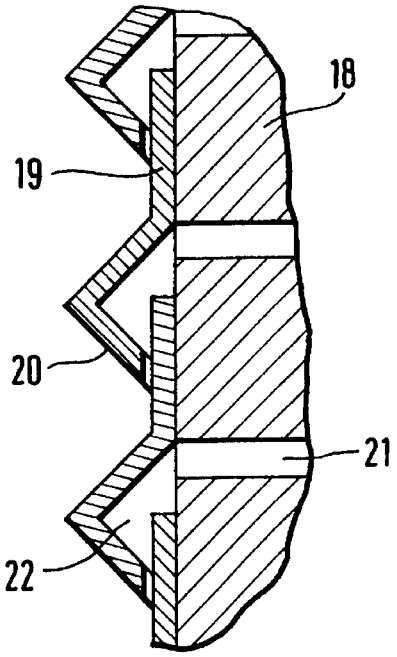
Figure 3:
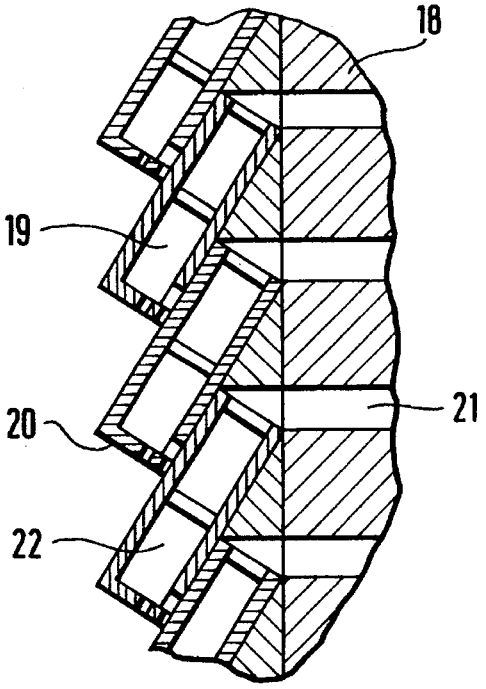
Figure 5:
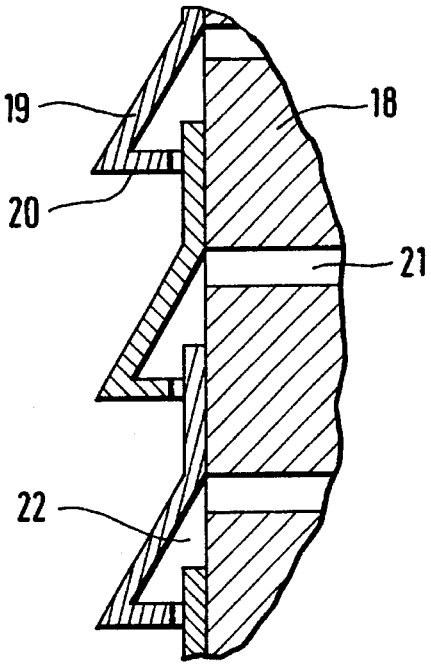

FIG. 2 shows schematically the configuration that may be given to such cooling air outlet ducts 21 in order on the one hand to effect intensive cooling of the stressing surfaces of the crushing jaws and on the other hand to avoid the risk of clogging by the material to be crushed. In this figure can be seen a crushing jaw 18, which on the crushing chamber side is covered with protective elements 19 in an imbricated arrangement. More precisely expressed, they do not extend parallel, but extend obliquely downwards and inwards into the crushing chamber, so that their bottom end faces 20 extend transversely to the crushing chamber and therefore are not or are only to a lesser extent exposed to the crushing pressure. They form for the crushing jaw surface a transverse profiling which is advantageous for the crushing process.

Outlet ducts 21 crossing through the crushing jaw 18 are extended by grooves or gaps 22 formed by spacer shims which are disposed between that surface of the crushing jaw 18 which carries the protective elements and the protective elements 19. The grooves 22 may equally well be formed in the surface of the crusher jaw 18 to follow a falling path, or be provided in the corresponding surface of the protective elements 19. The outlet ducts 21 lead out into or behind the end face 20.

In an embodiment of the protective elements 19 in the form of hollow bodies or of elements having a profiled configuration in accordance with FIGS. 2 to 5, the cooling air is guided through the hollow interior of the protective elements 19 and is blown out into the crushing chamber 9 via openings in the end face 20 and/or slot gaps at its bottom support edge.

Figure 6:
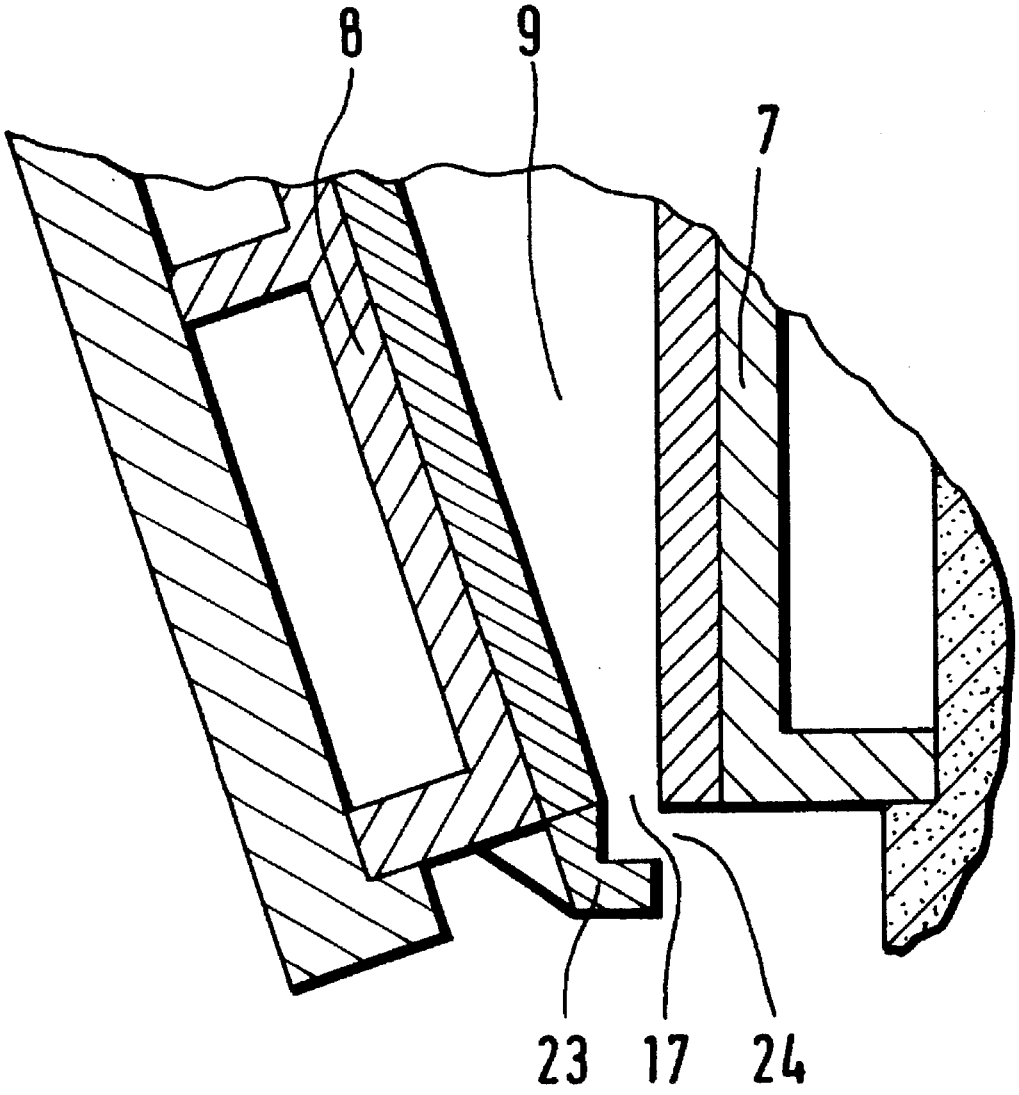
FIG. 6 is a partial section through the bottom end of the crusher.

FIG. 6 shows schematically the bottom part of the crushing chamber 9, together with the crusher outlet gap 17 and in particular the shear strip 23 which is frictionally Joined to one of the two crushing jaws, for example the movable crushing jaw 8. Taking also into account vertical movement components of the movable crushing jaw 8, it projects below the crusher outlet gap 17 by at least the distance 24 corresponding to the maximum outlet gap width adjustable in the operating state, and covers, preferably completely, the projected cross-section of the outlet gap during the closing stroke of the movable crushing jaw.

Through the provision of a shear strip 23 the effect is achieved that elongated particles of material to be crushed which pass through the outlet gap and which may have a side length nominally greater than the width of the outlet gap, are to a large extent further comminuted between the shear strip 23 and the bottom edge of the stationary crushing jaw 7. Regularly shaped bulk material which has a maximum final particle side corresponding to the adjusted outlet gap width and which leaves the crushing chamber 9 passes unstressed through the free cross-section between the bottom edge of the crushing jaw and the shear strip 23.

I claim:

1. In a combination of a furnace having an outlet for discharging high temperature cement clinker material, a cooler spaced from the outlet for receiving the discharged material for cooling thereof, a duct leading from the furnace outlet toward the cooler and a crushing unit mounted within the duct intermediate the furnace outlet and the cooler, the improvement wherein the crushing unit is a jaw crusher having a stationary jaw within the duct and a movable jaw immediately adjacent a side portion of the duct, said crushing jaws being provided with cooling devices, said movable jaw being movable relative to the stationary jaw and forming therewith a discharge crushing chamber for controlling the particle size of the high temperature material flowing through the duct toward the cooler.

2. The combination according to claim 1, characterized in that the cooling devices are formed by cooling air-swept ducts (16, 21, 22) which lead into the crushing chamber.

3. The combination according to claim 2, characterized in that the cooling air ducts (21, 22) extend downwardly behind imbricated armour plates (19).

4. The combination according to claim 1, characterized in that the cooling devices include air swept ducts and internal hollow chambers in the crushing jaws, said ducts communicating with said hollow chambers.

5. The combination according to claim 1, characterized in that the crusher chamber includes an adjustable outlet gap (17) and means for adjusting the gap are provided on the movable jaw (8).

6. The combination according to claim 5, characterized in that the crusher chamber outlet gap (17) can be adjusted to a size such that it permits the passage of uncrushed material.

7. The combination according to claim 1, characterized in that the side portion of the duct includes access means whereby at least the movable jaw (8) of the crusher can be moved out of the duct (5).

8. The combination according to claim 1, characterized in that the jaws flair apart at the top part (10) of the crushing chamber to serve as a receiving hopper for the maximum collection of material discharged from the furnace outlet.

9. The combination according to claim 1 characterized in that the bottom end of the crushing chamber (9) has an outlet gap and one of the jaws is provided with a shear strip (23) which covers the outlet gap (17) during movement of the movable jaw.

10. The combination according to claim 1 characterized in that the duct includes a partition (11) forming a hot air duct portion and separating the crushing chamber from the hot air duct portion (3) and the stationary crushing jaw (7) is mounted on or formed by said partition.

11. The combination according to claim 10 characterized in that the partition contains jaw cooling means for cooling the stationary jaw.

* * * * *